US005368130A

United States Patent [19]

Wilke et al.

[11] Patent Number: 5,368,130

[45] Date of Patent: Nov. 29, 1994

[54] LIFT TRUCK

[75] Inventors: Rudeger H. Wilke, Darien; David Floreani, Park Ridge, both of Ill.

[73] Assignee: Savage Bros. Co., Elk Grove Village, Ill.

[21] Appl. No.: 151,740

[22] Filed: Nov. 15, 1993

[51] Int. Cl.[5] ..... B66B 9/20

[52] U.S. Cl. ..... 187/236

[58] Field of Search ..... 187/9 R, 9 E, 24, 25, 187/11, 94; 280/47.11, 47.17, 47.24, 47.28; 254/98, 7 R, 7 B, 7 C, 4 R

[56] References Cited

U.S. PATENT DOCUMENTS

| | | | |
|---|---|---|---|
| 1,407,124 | 2/1922 | Carr | 187/9 R |
| 1,998,317 | 4/1935 | Harvey | 187/24 |
| 2,187,390 | 1/1940 | Anderson et al. | 187/24 |
| 2,227,111 | 12/1940 | Sturm | 187/24 |
| 4,421,209 | 12/1983 | Vermette et al. | 187/9 R |
| 4,427,094 | 1/1984 | Winkelblech | 187/9 R |
| 4,944,368 | 7/1990 | Duderstadt | 187/9 R |

FOREIGN PATENT DOCUMENTS

| | | | |
|---|---|---|---|
| 1566040 | 3/1969 | France | 187/9 R |

*Primary Examiner*—Kenneth W. Noland
*Attorney, Agent, or Firm*—Paul H. Gallagher

[57] ABSTRACT

A manually movable lift truck having a base with a self-contained power plant therein and a single column rising therefrom. The column includes a single hollow post with a drive transmitting screw shaft therein and a ball carriage on the shaft. A flexible chain has an outer end connected with the lift fork, and runs upwardly and then down into the interior of the post. The chain is drivingly connected with the ball carriage.

6 Claims, 2 Drawing Sheets

LIFT TRUCK

CROSS REFERENCES

Copending application of the present inventors, entitled Lift Truck, No. 08/151,739, filed Nov. 15, 1993.

FIELD OF THE INVENTION

The invention resides in a lift truck, particularly a self contained, manually movable lift truck, including a power plant. The power plant eliminates the necessity of plugging it into a house circuit, for moving the truck about the locality of its use, and then at a selected position, the power plant operates the fork of the lift truck.

A principal object of the invention is to provide such a lift truck that is extremely simple, and economical to manufacture, thereby enabling a low selling price.

Another principal object is to provide such a lift truck of extreme simplicity, and enclosing a substantial portion of the driving means, with a minimum exposure of movable parts or elements, thus eliminating liability to accident thereby, and providing corresponding safety.

More specifically, an object is to provide such a lift truck that includes a single post, and the upright driving means is nearly entirely enclosed within the post, with the only part exposed being the terminal end of a flexible member secured to the lift fork.

Another object is to provide, in a lift truck of the foregoing character, novel means for facilitating lifting and lowering of the load, and generally manipulating the entire device in a simple and easy manner.

Still another object is to provide a lift truck of the foregoing character that is of great strength, notwithstanding its small dimensions, this facilitating manually moving it about, and providing the necessary strength for handling loads of substantial weight.

BRIEF DESCRIPTION OF THE INDIVIDUAL FIGURES OF THE DRAWINGS

DETAILED DESCRIPTION

Figure 1:
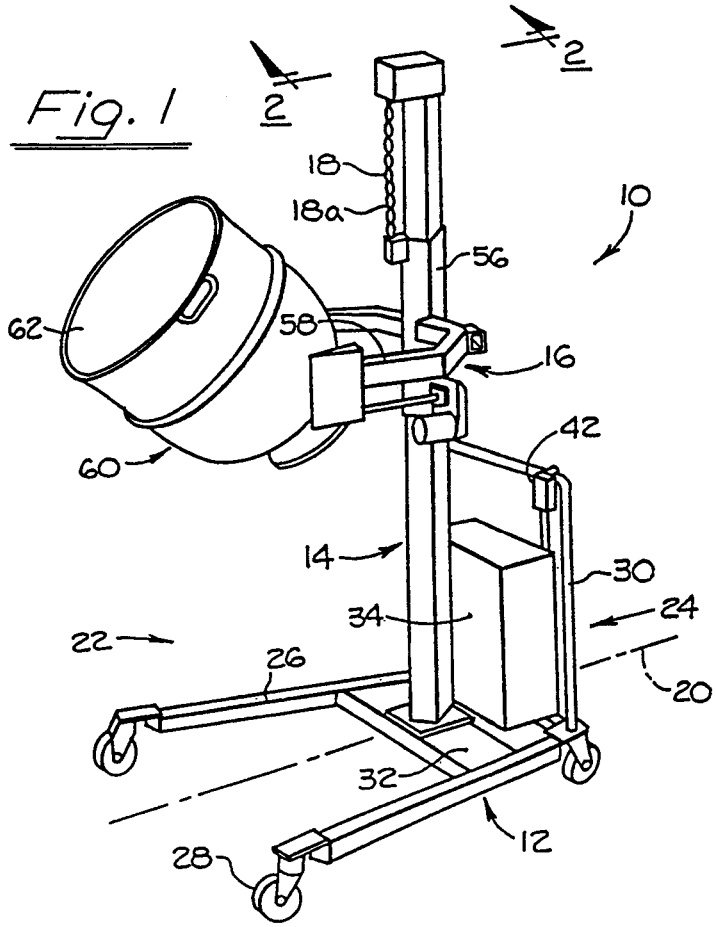
FIG. 1 is a perspective view of a lift truck embodying the features of the invention.

Referring in detail to the drawings, the lift truck of the invention is shown in perspective, in its entirety at 10, in FIG. 1. The lift truck includes three main parts or components, a base 12, a column 14, and a lift fork 16. It also contains a chain or flexible member 18, having an outer end 18*a* connected to the lift fork, and an inner end 18*b* extending down into the interior of the column. The lift truck is oriented according to a front-to-rear median line 20, indicating a front side 22 and a rear side 24.

The base 12 has a suitable frame 26 on which are mounted casters or wheels 28 for moving the lift truck to different locations. A suitable hand grip 30 is mounted on the base for gripping for manually pushing the lift truck.

Figure 2:
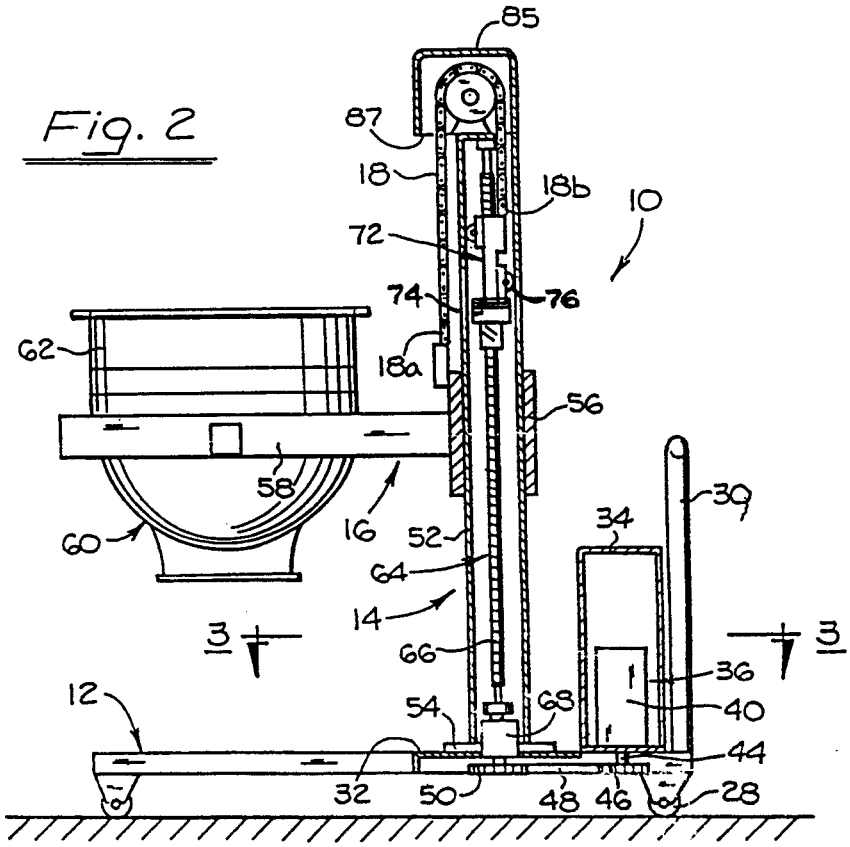
FIG. 2 is a vertical sectional view taken at line 2—2 of FIG. 1.
Figure 3:
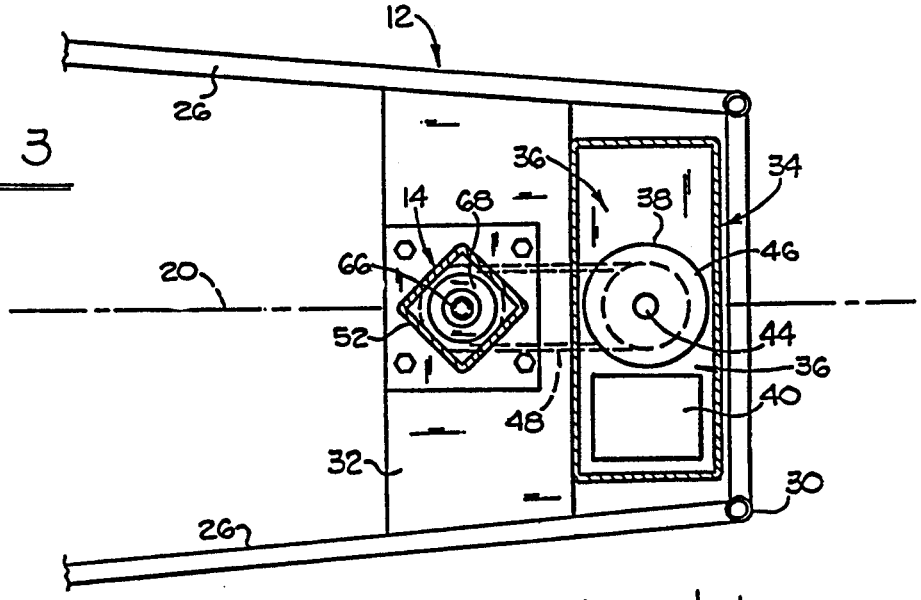
FIG. 3 is a sectional view taken at line 3—3 of FIG. 2.

The base includes a top platform or plate 32 on which is mounted a casing 34 in the form of a box. The casing contains a power plant 36 (FIG. 2) for driving the lift truck and lifting and lowering the fork, providing a self-contained feature. The power plant includes (FIG. 3) an electric motor 38 and a battery 40, the battery being of suitable voltage such as 12 V. Suitable switches and control elements 42 for controlling the drive motor are mounted in a suitable location such as on the hand grip 30.

The drive motor 38 has a drive shaft 44 extending downwardly below the plate 32, the plate being elevated a short distance above the supporting floor. The drive shaft has a drive sprocket 46 on which is trained a toothed belt 48 which is also trained on another sprocket 50 incorporated in the drive transmitting mechanism described below. The operating elements below the plate 32 are effectively enclosed.

The column 14 includes a post 52 rigidly mounted on the base. It is rectangular in cross-section, preferably square, with corners directed front-to-rear long the line 20, for strength in supporting the load on the fork. The post, of steel, is preferably welded to the base plate 32 as indicated at 54 and extends upwardly a suitable distance such as for example 6 feet, 7 feet, 8 feet, etc. Located in the post are certain drive transmitting elements which will be described in detail hereinbelow.

The lift fork 16 includes a sleeve 56 slidable on the post and having lifting arms 58 extending forwardly and spaced apart, and arranged for swivelly mounting a mixing bowl 60 in which is placed a tub 62. The use of the lift truck with respect to the mixing bowl and tub, is known, i.e. a quantity of mix is placed in the tub, the lift truck pushed to another location, and the tub is emptied by tilting it. Suitable means of known kind are used for tilting the mixing bowl, driven by the motor 38, and controlled by the switches 42. The sleeve 56 is freely slidable on the post and may be of any desired specific construction, either as a simple tubular element, or, instead, one having slide pads of the kind covered by U.S. Pat No. 5,199,533. The connection of the outer end 18*a* of the chain 18 is preferably made directly with the upper end of the sleeve 56.

The drive transmitting means in the post is indicated in its entirety at 64, and includes a ball screw 66 mounted in suitable bearings 68 at the bottom and 70 at the top. The screw is in the form of a shaft, and it extends through the bearing 68 into the space below the plate 32 and on its lower end is mounted the sprocket 50 identified above. Upon operation of the motor 38, the sprocket 50 is driven through the belt 48, and the ball screw rotated.

Figure 4:
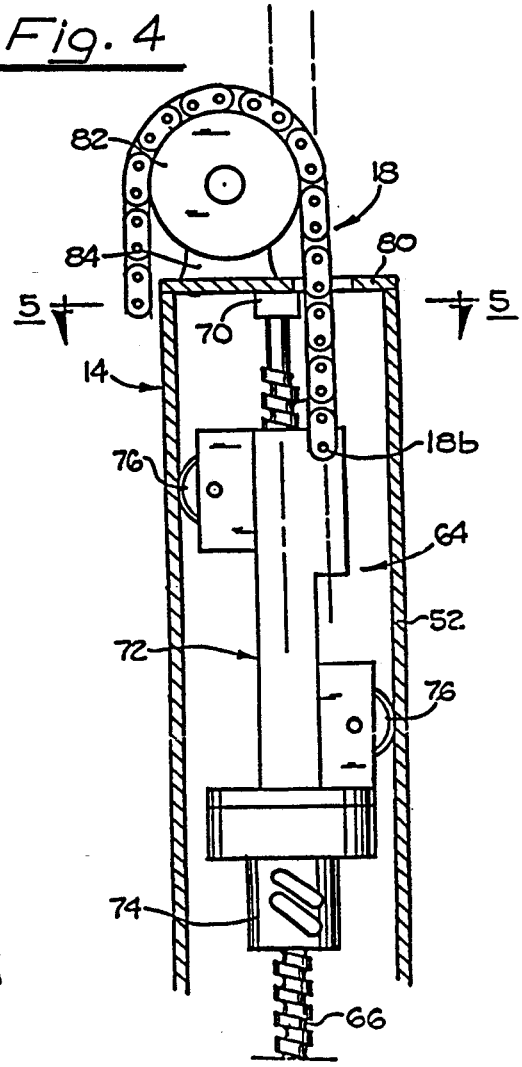
FIG. 4 is a sectional view of the upper part of the vertical column of the device.
Figure 5:
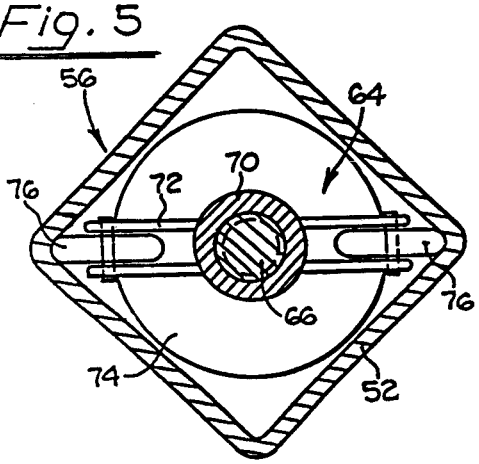
FIG. 5 is a view taken at line 5—5 of FIG. 4.

The ball screw itself is of known kind, and operably mounted on the screw is a ball assembly or carriage 72, (FIGS. 2 and 4), which is driven up or down by the screw 66. The ball assembly includes a bell nut 74 having bearing balls engaged in the groove in the screw. The carriage includes guide rollers 76 on opposite sides of the carriage, and engageable with the post at the front and rear corners of the post. Two such rollers may be adequate, but if desired three or more may be utilized.

The chain 18 leads (FIGS. 2 and 4) from its connection at its inner end 18*b* to the carriage 72, through a top plate 80 of the post and over a sprocket 82 which is mounted by means 84 on the upper end of the post, and exteriorly thereof. The chain then runs down and is connected at its outer end 18*a* to the fork as referred to above. A suitable cap or cover 85 preferably is provided on the top of the post, having a side bottom opening 87. The sprocket 82 thus diverts the direction of drive from the, interior of the post to the exterior and to the fork.

Figure 6:
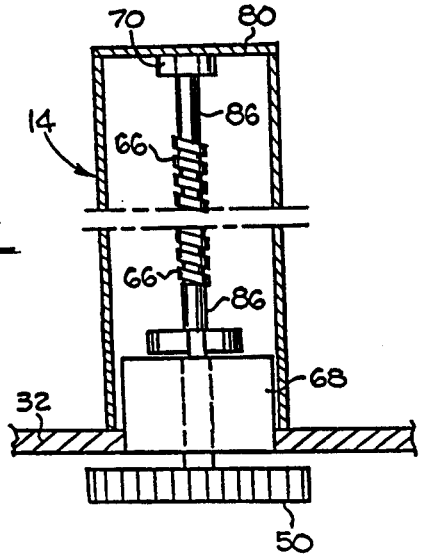
FIG. 6 is a view oriented according to FIG. 2 but showing only the upper and lower end portions of the vertical column.

To facilitate the rolling engagement of the bearing balls in the groove, at the ends of the groove, the ball screw is formed as shown in FIG. 6 where the screw thread terminates short of the ends of the shaft, leaving reduced segments or lengths 86, of the root diameter of the screw. This formation prevents binding of the bearing balls or any part of the ball carriage in the movement of the carriage at the ends of its movement.

A safety feature of the device of the invention is now referred to, i.e. except for the external exposure of the lift fork and sleeve, which is necessary for functioning of the device, the only other exterior member that is moveable is the chain 18, and more specifically only the outer portion of it from the top of the column down to the sleeve 56. The remainder of the chain is in the interior of the post, and thus enclosed. This reduces the danger in handling the lift truck, since the exposed part of the chain is very close to the post and does not extend to any appreciable extent away from the post, providing a great safety factor. Other moving parts are enclosed, i.e. motor sprockets and belt, ball screw, carriage and top sprocket. The drive means may include a high-ratio reduction means, serving as a brake for holding the fork in elevated position. Any of various kinds of brake means may be utilized, as desired.

Thus the greatest part of the vertical drive means is contained in the post 52, which is of extremely small dimensions. The screw shaft 66 is by nature slim and of small transverse dimensions, and the other components and elements mounted on and associated with it, are in an extremely small-dimension arrangement, and the enclosure of these elements provides a great degree of safety.

We claim:

1. A portable lift truck comprising, a base having wheels for movement of the lift truck, a single hollow post on the base at one side of the base, having a top opening adjacent its top, a fork slidable on the post, a drive motor on the base, and a casing enclosing the motor, a vertical screw shaft mounted in the post and enclosed therein and extending the full length of the post rotatable but fixed in position bodily, a flexible member having an outer end connected with the fork exteriorly of the post, and extending through said opening and having an inner end within the post, and a drive transmitting member on the shaft and entirely contained in the post and connected with the flexible member and operable in response to rotation of the shaft for moving the flexible member linearly.

2. A lift truck according to claim 1 wherein, the post is peripherally continuous and imperforate, and is open only at its ends.

3. A portable lift truck according to claim 1 wherein, the drive transmitting member is a ball unit having bearing balls in the groove of the shaft, and the shaft has reduced segments at its ends of the pitch diameter of the shaft.

4. A lift truck according to claim 1 wherein, the inner end of the flexible member extends into the post along a line parallel with the axis of the screw shaft and is connected with the drive transmitting member at a point in said line, and the drive transmitting member includes guide rollers for engaging the inner surface of the post at points lying in a plane containing said axis and said line.

5. A portable lift truck according to claim 1 wherein, the flexible member is constituted solely by that portion between its said outer and inner ends.

6. A portable lift truck according to claim 1 wherein, the only portion of the flexible member that is exposed to the exterior is that portion between its said outer end and said top opening.

* * * * *